US010164326B2

(12) United States Patent
Urcia et al.

(10) Patent No.: US 10,164,326 B2
(45) Date of Patent: Dec. 25, 2018

(54) FREQUENCY-SELECTIVE SURFACE COMPOSITE STRUCTURE

(71) Applicant: The Boeing Company, Chicago, IL (US)

(72) Inventors: Manny S. Urcia, Wildwood, MO (US); Daniel J. Braley, St. Peters, MO (US); Ronald O. Lavin, Gilbert, AZ (US)

(73) Assignee: The Boeing Company, Chicago, IL (US)

( * ) Notice: Subject to any disclaimer, the term of this patent is extended or adjusted under 35 U.S.C. 154(b) by 303 days.

(21) Appl. No.: 15/171,561

(22) Filed: Jun. 2, 2016

(65) Prior Publication Data

US 2017/0352948 A1 Dec. 7, 2017

(51) Int. Cl.

| | |
|---|---|
| ***H01Q 1/28*** | (2006.01) |
| ***H01Q 1/40*** | (2006.01) |
| ***H01Q 1/48*** | (2006.01) |
| ***H01Q 3/22*** | (2006.01) |
| ***H01Q 15/00*** | (2006.01) |
| *H01Q 1/42* | (2006.01) |

(52) U.S. Cl.

CPC ..... *H01Q 1/286* (2013.01); *H01Q 1/40* (2013.01); *H01Q 1/48* (2013.01); *H01Q 3/22* (2013.01); *H01Q 15/0013* (2013.01); *H01Q 1/42* (2013.01)

(58) Field of Classification Search

CPC .. H01Q 1/40; H01Q 1/42; H01Q 3/22; H01Q 1/286; F41H 3/00; H04R 17/005

USPC ..... 343/713; 342/3

See application file for complete search history.

(56) References Cited

U.S. PATENT DOCUMENTS

| | | | | |
|---|---|---|---|---|
| 5,400,043 | A | 3/1995 | Arceneaux et al. | |
| 6,208,316 | B1 | 3/2001 | Cahill | |
| 8,077,071 | B2 * | 12/2011 | Cincotti | F41H 3/00 342/3 |
| 2007/0237705 | A1 * | 10/2007 | Itoh | B81C 1/00206 423/447.1 |
| 2010/0271692 | A1 | 10/2010 | Hor et al. | |
| 2014/0125506 | A1 * | 5/2014 | Sjolund | F41H 3/00 342/3 |
| 2014/0312248 | A1 * | 10/2014 | Beck | G01N 21/65 250/459.1 |
| 2015/0343884 | A1 | 12/2015 | Rousselet et al. | |
| 2016/0277843 | A1 * | 9/2016 | Babayoff | H04R 17/005 |
| 2017/0158511 | A1 | 6/2017 | Braley et al. | |
| 2017/0162300 | A1 | 6/2017 | Hasan et al. | |
| 2017/0291332 | A1 | 10/2017 | Braley et al. | |

FOREIGN PATENT DOCUMENTS

| | | |
|---|---|---|
| CN | 104934717 | 9/2015 |
| EP | 2916387 | 9/2015 |

OTHER PUBLICATIONS

European Patent Office, Extended European Search Report, EP 17 17 2404 (dated Oct. 26, 2017).

* cited by examiner

*Primary Examiner* — Peguy Jean Pierre

(74) *Attorney, Agent, or Firm* — Walters & Wasylyna LLC

(57) ABSTRACT

A frequency-selective composite structure includes a laminate panel, and a frequency-selective filter including a plurality of frequency-selective surface elements coupled to an exterior surface of the laminate panel and arranged in a frequency-selective surface pattern, wherein each one of the frequency-selective surface elements includes a nanomaterial composite.

20 Claims, 9 Drawing Sheets

FREQUENCY-SELECTIVE SURFACE COMPOSITE STRUCTURE

FIELD

The present disclosure is generally related to composite materials and, more particularly, to a composite structure having an integral frequency-selective surface filter and multifunctional layer.

BACKGROUND

Antennas that are enclosed or embedded within a mobile structure, such as an aircraft, are subject to numerous system requirements including lightning strike mitigation, bandpass filtering and electromagnetic interference shielding. Example solutions to these requirements include the use of frequency selective surfaces and lightning diverter strips that are disposed on an outer surface of the structure, for example, forming a radome or other structural or non-structural component. Typically, the frequency selective surface and the lightning diverter strips are bonded to the outer surface of the enclosing structure as an applique, which is prone to damage or dis-bonding through delamination of the applique from the surface of the enclosing structure or environmental exposure. Further, any electromagnetic interference shielding is limited to the shielding effectiveness of the constituent materials of the frequency selective surface and the lightning diverter strip.

Accordingly, those skilled in the art continue with research and development efforts in the field of enclosed antenna systems and enclosing structures having embedded antenna systems.

SUMMARY

In one embodiment, the disclosed frequency-selective composite structure includes a laminate panel, and a frequency-selective filter including a plurality of frequency-selective surface elements coupled to an exterior surface of the laminate panel and arranged in a frequency-selective surface pattern, wherein each one of the frequency-selective surface elements includes a nanomaterial composite.

In another embodiment, the disclosed antenna system includes a frequency-selective composite structure including a laminate panel, and a frequency-selective filter including a plurality of frequency-selective surface elements coupled to an exterior surface of the laminate panel and arranged in a frequency-selective surface pattern, wherein each one of the frequency-selective surface elements includes a nanomaterial composite, and an RF antenna positioned behind the frequency-selective filter.

In yet another embodiment, the disclosed method for making a frequency-selective surface composite structure may include the steps of: (1) providing a laminate panel, (2) providing a frequency-selective surface filter including a plurality of frequency-selective surface elements coupled to an exterior surface of the laminate panel and arranged in a frequency-selective surface pattern, wherein each one of the frequency-selective surface elements includes a nanomaterial composite, and (3) joining the frequency-selective surface filter to the laminate panel.

Other embodiments of the disclosed apparatus and method will become apparent from the following detailed description, the accompanying drawings and the appended claims.

DETAILED DESCRIPTION

Figure 1:
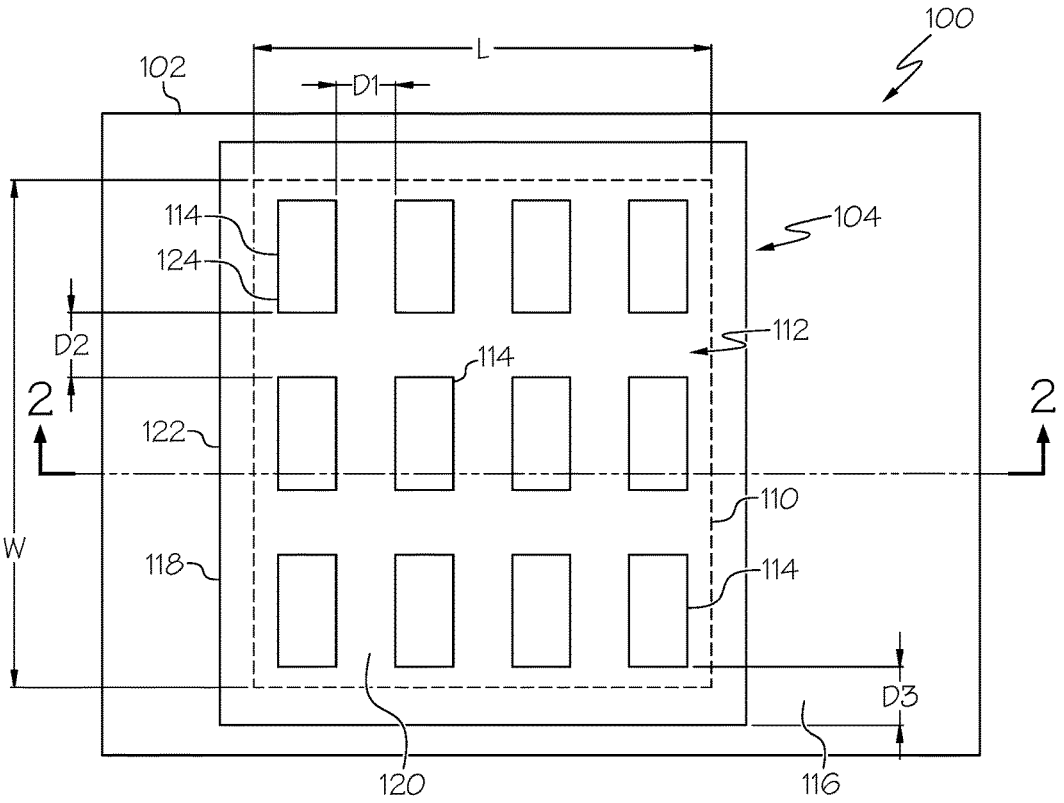
FIG. 1 is a schematic top plan view of one embodiment of the disclosed frequency-selective surface composite structure.

The following detailed description refers to the accompanying drawings, which illustrate specific embodiments and/or examples described by the disclosure. Other embodiments and/or examples having different structures and operations do not depart from the scope of the present disclosure. Like reference numerals may refer to the same feature, element or component in the different drawings.

Illustrative, non-exhaustive embodiments, which may be, but are not necessarily, claimed, of the subject matter according the present disclosure are provided below.

The present disclosure recognizes and takes into account that aerospace vehicles, such as aircraft, are being designed and manufactured with greater percentages of composite materials. For example, composites may be used in the construction of various primary and secondary structures in aerospace applications, such as composite panels forming the airframe and/or the exterior skin (e.g., fuselage, wings, stabilizers, etc.) of the aircraft.

The present disclosure also recognizes and takes into account that in aerospace vehicles having composite components, such as skin panels, it may be desirable to apply additional materials for lightning strike protection and/or to shield associated avionics and electronics from external electromagnetic interference (EMI).

The present disclosure also recognizes and takes into account that most modern aerospace vehicles utilize antenna systems to transmit and/or receive radio frequency (RF) communications. The particular type of antenna and/or the location of the antenna must account for various factors, such as environmental exposure (e.g., airflow, ice accretion, lightning strike susceptibility, etc.), structural and coverage requirements (e.g., airframe shadowing, ground clearance, antenna crowding, etc.) and/or aerodynamic effects (e.g., weight, wind drag, etc.)

Described herein is a frequency-selective surface (FSS) composite structure 100. The disclosed FSS composite structure 100 includes a FSS filter 104 formed from a nanomaterial composite 126 that provides integral bandpass filtering for designated operating frequencies, enhanced durability and damage protection, broadband electromagnetic interference shielding effectiveness, and lightning strike protection.

Figure 2:
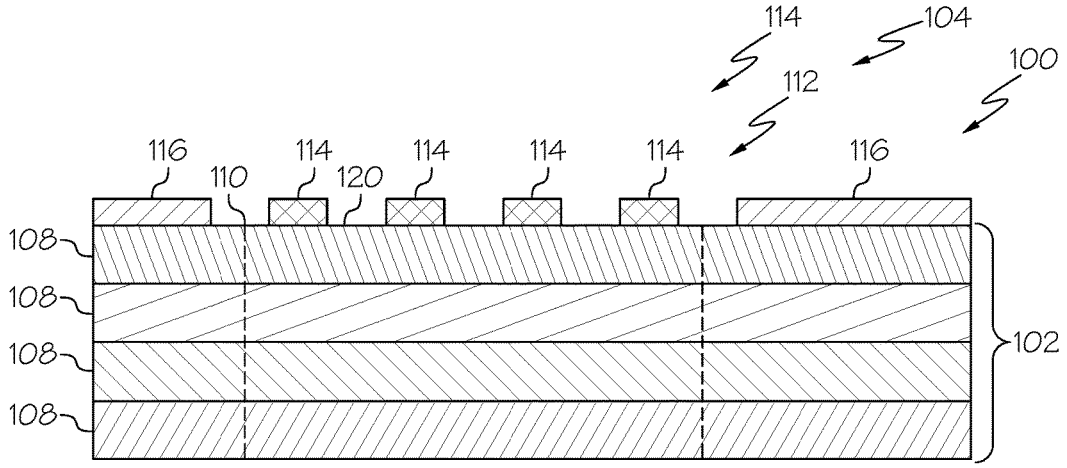
FIG. 2 is a schematic side elevation view, in section, of the disclosed frequency-selective surface composite structure of FIG. 1.

FIG. 1 is a schematic top plan view of one embodiment of the FSS composite structure 100. FIG. 2 is a schematic side elevation view, in section, of the FSS composite structure 100 shown in FIG. 1. In the illustrated embodiment, the FSS composite structure 100 includes a laminate panel 102 and a FSS filter 104. As one example, the laminate panel 102 includes a panel-exterior surface 120 and the FSS filter 104 is coupled to the panel-exterior surface 120.

The FSS filter 104 includes a plurality of FSS elements 114 arranged in a FSS pattern 112. The plurality of FSS elements 114 (e.g., each one of the plurality of FSS elements 114) is coupled to the laminate panel 102, for example, to the panel-exterior surface 120. The FSS filter 104 allows electromagnetic radiation (e.g., electromagnetic waves) of one or more operating frequencies to pass through the FSS filter 104 and reflects or absorbs electromagnetic radiation having one or more other operating frequencies. Thus, the FSS filter 104 defines a radio frequency (RF) window 110.

Figure 14:
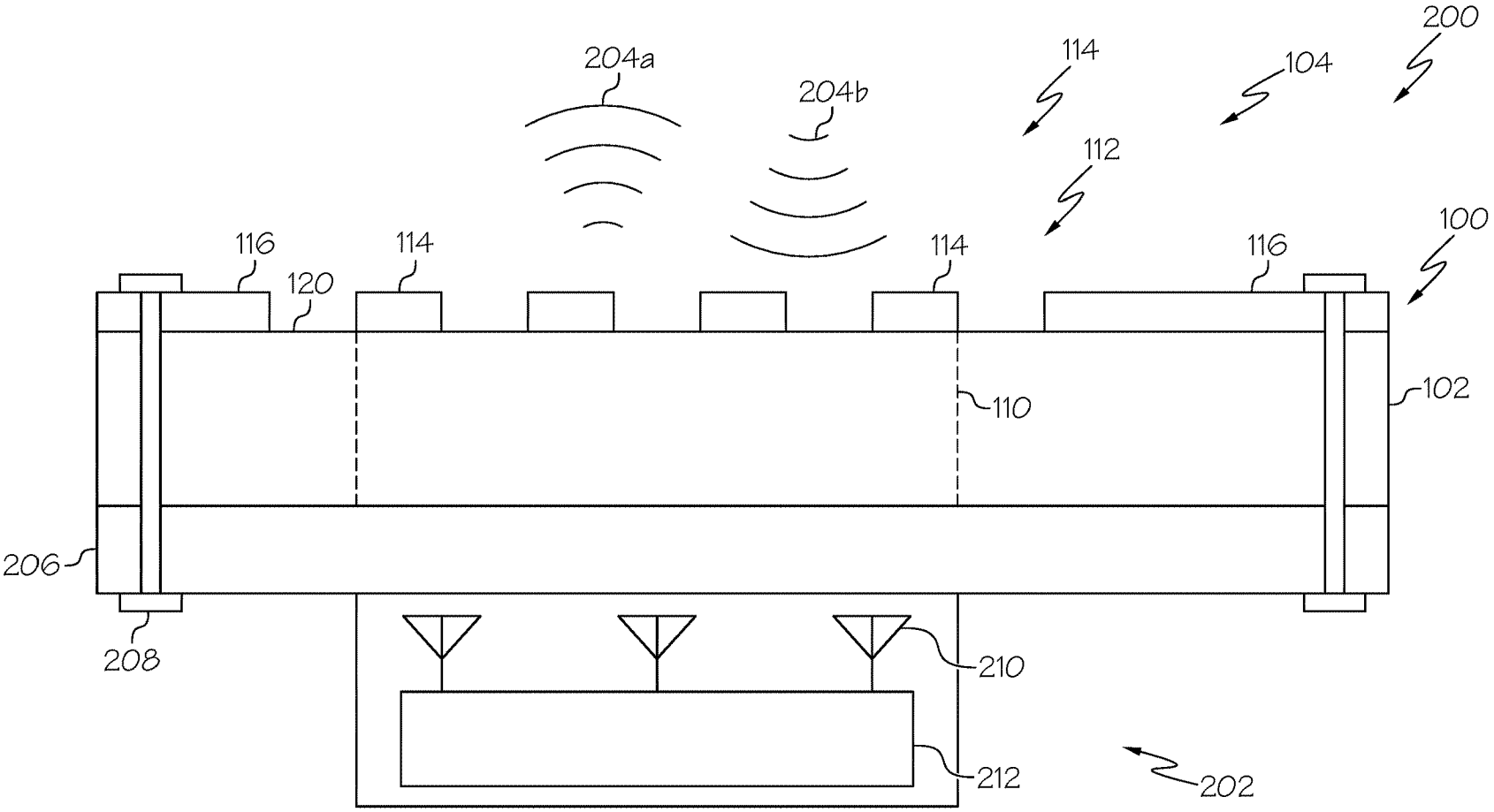
FIG. 14 is a schematic illustration of one embodiment of the disclosed antenna system.

The RF window 110 is formed by the FSS pattern 112 of FSS elements 114. The RF window 110 is configured to be electromagnetically transparent to electromagnetic radiation at one or more select or predefined frequencies or wavelengths (e.g., first electromagnetic radiation 204*a*) (FIG. 14) and to be electromagnetically opaque to electromagnetic radiation at one or more other select or predefined frequencies or wavelengths (e.g., second electromagnetic radiation 204*b*) (FIG. 14). As will be described in greater detail herein, in one example, the RF window 110 formed by the FSS filter 104 (e.g., the FSS pattern 112 of FSS elements 114) is configured to not interfere with RF signals (e.g., radio waves) transmitted and/or received by an RF antenna 202 (FIG. 14).

In an exemplary embodiment of the FSS composite structure 100, the RF window 110 is defined by the electromagnetically transparent FSS pattern 112. The FSS pattern 112 includes (e.g., is formed by) the plurality of electromagnetically transparent FSS elements 114. As illustrated in FIG. 1, the FSS elements 114 may extend the length L and the width W of the RF window 110.

In an example configuration, the FSS elements 114 defining the FSS pattern 112 are equally spaced apart from one another. In another example configuration, the FSS elements 114 defining the FSS pattern 112 are unequally spaced apart from one another. In another example configuration, the FSS elements 114 defining the FSS pattern 112 are coaxially aligned with one another along at least one axis. In yet another example configuration, the FSS elements 114 defining the FSS pattern 112 are offset (e.g., staggered) along at least one axis.

As referenced above, the design of frequency-selective bandpass properties of the FSS filter 104 may require equal or unequal spacing adjustments between FSS elements 114, coaxial alignment of FSS elements 114, offset (e.g., staggered) alignments of FSS elements 114, and selection of geometry, and may be dependent upon the combination of materials selected. The choices of implementing the distributed conductivities, capacitances, and inductances to achieve a given bulk material or tensor frequency response, power dissipation or absorption, current flow, reflection, refraction, or shielding effectiveness may be preselected based on the desired system properties. As an example, FSS elements 114 may be defined in repeating geometric patterns including squares, grids, crosses, and other geometries, for example, made from regions consisting of different combinations of carbon and boron nanospheres.

Each one of the FSS elements 114 includes a two-dimensional FSS element-perimeter shape 124 (e.g., a two-dimensional geometry). As examples, the FSS element-perimeter shape 124 includes, but is not limited to, a rectangular shape, a square shape, a circular shape, a triangular shape, an ovular shape, a plus sign shape, an ogive shape (e.g., having at least one roundly tapered end), a cross shape, a chicken-foot shape, an X shape, or a polygonal shape (e.g., a hexagon, octagon, etc.).

In one embodiment of the FSS composite structure 100, the laminate panel 102 includes one or more fiber-reinforced polymer (FRP) plies 108 (FIG. 2). Each of the FRP plies 108 may include structural and transmissive characteristics and/or properties. The total number of FRP plies 108 may vary as dictated by, for example, the desired structural and/or transmissive characteristics of laminate panel 102, the desired purpose of FSS composite structure 100 and the like.

As an example, each FRP ply 108 includes a sheet or mat of reinforcing fibrous material (not explicitly illustrated) bonded together by a polymer matrix material (not explicitly illustrated). The polymer matrix material may include any suitable thermoset resin (e.g., epoxy) or thermoplastic. The fibrous material may include any suitable woven or nonwoven (e.g., knit, braided or stitched) continuous reinforcing fibers or filaments. In an example, the FRP ply 108 includes a sheet of the reinforcing fibrous material pre-impregnated with the polymer matrix material (e.g., a pre-preg), also referred to as a dry lay up. In another example, the FRP ply 108 includes a sheet of the reinforcing fibrous material and the polymer matrix material is applied to the reinforcing fibrous material, also referred to as a wet lay up. The structural and transmissive characteristics of the FRP ply 108 may be based on the selected reinforcing fibrous material and/or the polymer matrix material and include, but are not limited to, tensile strength, electrical conductivity, and/or dielectric constant and loss tangent.

In an exemplary embodiment, the FRP ply 108 is a dielectric and allows the passage of electromagnetic radiation (e.g., radio waves). As an example, the FRP ply 108 is a low loss fiberglass fiber-reinforced polymer. As another example, the FRP ply 108 is a low loss quartz fiber-reinforced polymer (e.g., an astro-quartz cyanate-ester). As yet another example, the FRP ply 108 is a low loss glass fiber-reinforced polymer.

The FSS filter 104 allows electromagnetic radiation at a predetermined frequency (e.g., first electromagnetic radiation 204*a*) to pass through the FSS composite structure 100 and prevents electromagnetic radiation at a predetermined frequency (e.g., second electromagnetic radiation 204*b*) from passing through the FSS composite structure 100. Further, the FSS pattern 112 of FSS elements 114 also allows for the distribution of voltage along an exterior surface of the FSS composite structure 100, for example, in response to a lightning strike.

In the illustrated embodiment, the FSS composite structure 100 also includes a multifunctional layer 116 coupled to the laminate panel 102. In an example, the multifunctional layer 116 covers at least a portion of the panel-exterior surface 120 of the laminate panel 102 surrounding the FSS filter 104. In another example, the multifunctional layer 116 covers the entirety of the panel-exterior surface 120 of the laminate panel 102 surrounding the FSS filter 104. As an example construction, the multifunctional layer 116 includes (e.g., defines) an opening 118. The FSS filter 104 is disposed (e.g., the FSS pattern 112 of FSS elements 114 are located) within the opening 118. The opening 118 includes a two-dimensional opening-perimeter shape 122 (e.g., a two-dimensional geometry). The opening-perimeter shape 122 may depend upon the configuration or arrangement of the FSS elements 114 forming the FSS pattern 112.

The multifunctional layer 116 further allows for the distribution of voltage along the exterior surface of the FSS composite structure 100, for example, in response to a lightning strike. The multifunctional layer 116 also provides broadband EMI shielding effectiveness. Thus, the multifunctional layer 116 provides the FSS composite structure 100 with effective shielding against, for example, EMI and ionizing radiation, and effective lighting strike protection, for example, in areas outside of the FSS filter 104, without the need for additional materials.

In an example configuration, and as illustrated in FIG. 1, each one of the FSS elements 114 defining the FSS pattern 112 are spaced away from each other one of the FSS elements 114 by a distance D1 along one axis and/or D2 along another axis. The FSS elements 114 are also spaced away from the multifunctional layer 116 by a distance D3. The distances D1 and D2 between adjacent FSS elements 114 allow voltage to jump between adjacent ones of the FSS elements 114 and skip across the FSS pattern 112. The distance D3 between the multifunctional layer 116 and adjacent FSS elements 114 allows voltage to jump from the FSS elements 114 to the multifunctional layer 116.

Figure 3:
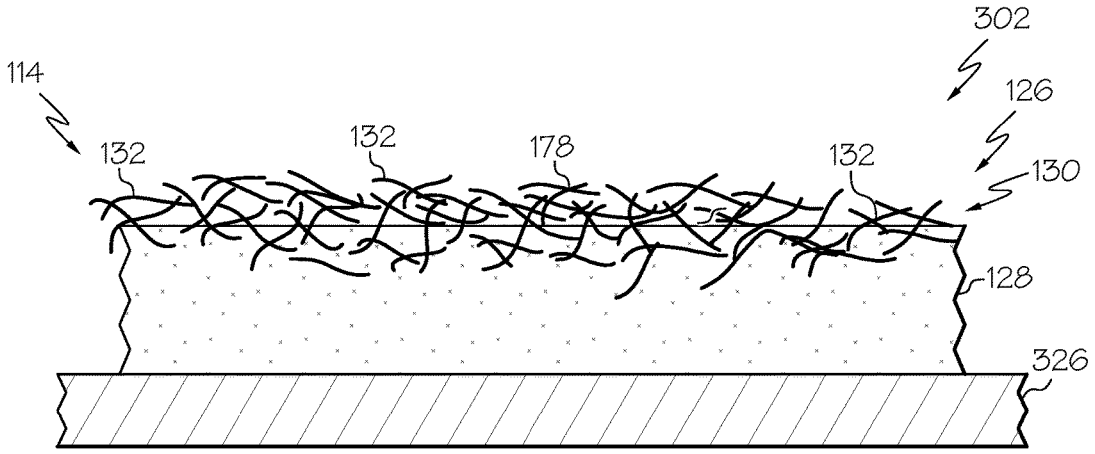
FIG. 3 is a schematic partial side elevation view, in section, of one embodiment of the disclosed nanomaterial composite.
Figure 4:
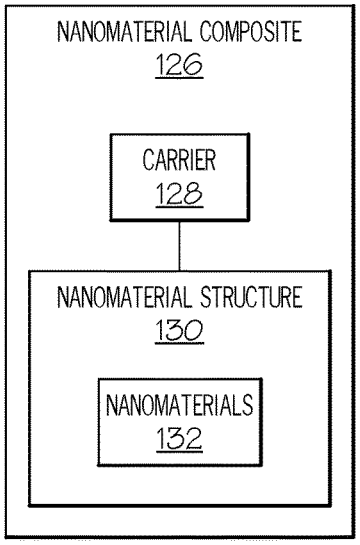
FIG. 4 is a schematic block diagram of the disclosed nanomaterial composite of FIG. 3.

FIG. 3 is a schematic partial side elevation view, in section, of one embodiment of the nanomaterial composite 126. FIG. 4 is a schematic block diagram of the nanomaterial composite of FIG. 3. In an exemplary embodiment of the FSS composite structure 100, each one of the FSS elements 114 includes (is formed from) the nanomaterial composite 126. In another exemplary embodiment of the FSS composite structure 100, the multifunctional layer 116 also includes (e.g., is formed from) the nanomaterial composite 126. In an exemplary embodiment of the nanomaterial composite 126, the nanomaterial composite 126 includes a carrier 128 and a nanomaterial structure 130 bonded to the carrier 128.

In the illustrated embodiment, the nanomaterial structure 130 includes nanomaterials 132 built upon the carrier 128. For example, the nanomaterial structure 130 is bonded to the carrier 128. As an example, the nanomaterials 132 are overlaid onto the carrier 128 to form the nanomaterial structure 130, such that the nanomaterial structure 130 is integrally bonded to the carrier 128. In such an example, the nanomaterial structure 130 is permanently bonded to the carrier 128.

In an exemplary embodiment, and as best illustrated in FIG. 3, at least some of nanomaterials 132 are interspersed through the thickness of the carrier 128 and entangled with the carrier 128 to bond (e.g., permanently bond) the nanomaterial structure 130 to the carrier 128. Accordingly, in an example, the nanomaterial structure 130 is (e.g., takes the form of) a sheet or layer structure that includes an entangled network of the nanomaterials 132. As an example, the nanomaterials 132 are randomly distributed or oriented on the surface of the carrier 128. As another example, the nanomaterials 132 are uniformly distributed or oriented on the surface of carrier 128.

In an example construction, entanglement between the nanomaterials 132 occurs at various crossover locations 178 between different ones of the nanomaterials 132. The network of entangled nanomaterials 132 includes a sufficient amount of the nanomaterials 132 to provide a sufficient number of crossover locations 178 to achieve a stable nanomaterial structure 130.

Figure 5:
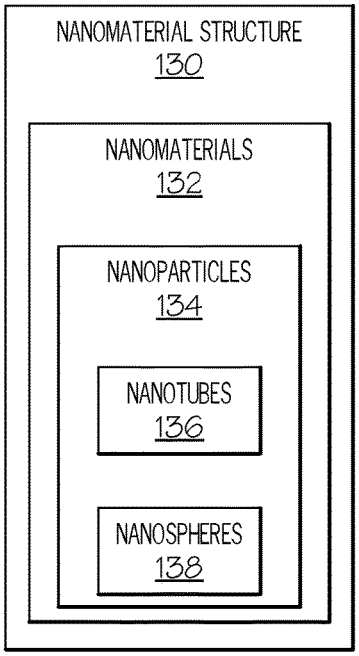
FIG. 5 is a schematic block diagram of one embodiment of a nanomaterial structure of the nanomaterial composite of FIG. 4.

FIG. 5 is a schematic block diagram of one embodiment of the nanomaterial structure 130 of the nanomaterial composite 126 of FIG. 4. The nanomaterials 132 forming the nanomaterial structure 130 may take various forms. As an example, the nanomaterials 132 are (e.g., take the form of) nanoparticles 134. The nanoparticles 134 may have various geometries. As an example, the nanoparticles 134 include (e.g., take the form of) nanotubes 136. As another example, the nanoparticles 134 include (or take the form of) nanospheres 138. As yet another example, the nanoparticles 134 include at least one of or a combination of the nanotubes 136 and/or the nanospheres 138. While various specific geometries of different types of nanoparticles 134 have been provided as examples, nanoparticles 134 having other geometries are also contemplated.

Depending upon the type and/or geometry of the nanomaterials 132 (e.g., the nanotubes 136, the nanospheres 138, or other nanoparticles 134), the size of the nanomaterials 132 may vary. As an example, the nanotubes 136 have an extremely high aspect ratio (length to diameter ratio), for example, of at least 2,500:1. As an example, the nanotubes 136 have a length ranging from approximately 0.5 millimeter to approximately 4 millimeters and a diameter ranging from approximately 1 nanometer to approximately 50 nanometers. Other suitable dimensions of the nanomaterials 132 are also contemplated, for example, to tailor mechanical and/or electrical properties.

Due to the small size of the nanomaterials 132, at least some the nanomaterials 132 may at least partially disperse and integrate throughout the carrier 128, as illustrated in FIG. 3. As an example, at least some of the nanomaterials 132 penetrate and intersperse at least partially through a thickness (e.g., a through-thickness) of the carrier 128 and entangle and integrate with the carrier 128. Accordingly, the nanomaterial structure 130 is effectively coupled or bonded to the carrier 128.

As an example, the nanomaterials 132 are concentrated proximate to (e.g., at or near) the surface of the carrier 128 (FIG. 3). As another example, the nanomaterials 132 are partially interspersed and entangled throughout the thickness of the carrier 128. As yet another example, the nanomaterials 132 are completely interspersed and entangled throughout the thickness of the carrier 128.

Figure 6:
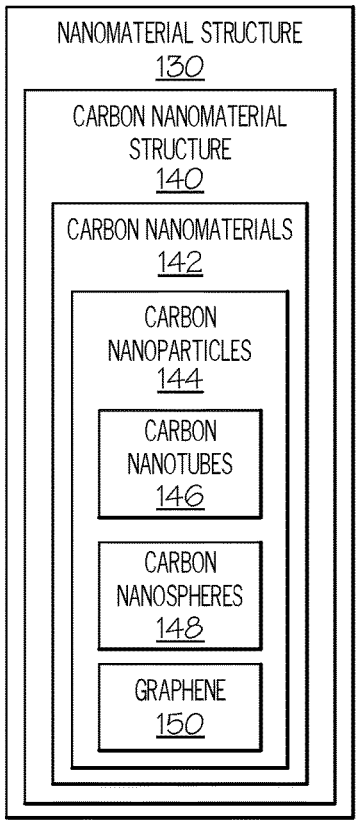
FIG. 6 is a schematic block diagram of another embodiment of the nanomaterial structure of the nanomaterial composite of FIG. 4.

FIG. 6 is a schematic block diagram of another embodiment of the nanomaterial structure 130 of the nanomaterial composite 126 of FIG. 4. In the illustrated embodiment of the nanomaterial structure 130, the nanomaterial structure 130 is a carbon nanomaterial structure 140. The carbon nanomaterial structure 140 is coupled to the carrier 128. The carbon nanomaterial structure 140 includes carbon nanomaterials 142 built upon the carrier 128. Thus, in such an embodiment, the nanomaterial composite 126 is a carbon nanomaterial composite.

The carbon nanomaterials 142 forming the carbon nanomaterial structure 140 may take various forms. As an example, the carbon nanomaterials 142 are (e.g., take the form of) carbon nanoparticles 144. The carbon nanoparticles 144 may have various geometries. As an example, the carbon nanoparticles 144 include (e.g., take the form of) carbon nanotubes 146. As another example, the carbon nanoparticles 144 include (or take the form of) carbon nanospheres 148. As another example, the carbon nanoparticles 144 include (or take the form of) graphene 150 (e.g., graphene sheets or flakes). As yet another example, the carbon nanoparticles 144 include at least one of or a combination of the carbon nanotubes 136, the carbon nanospheres 148 and/or graphene. While various specific geometries of different types of carbon nanoparticles 144 have been provided as examples, carbon nanoparticles 144 having other geometries are also contemplated.

Referring specifically to carbon nanotubes 146, in an example, the carbon nanotubes 146 are single wall carbon nanotubes (SWCNTs). In another example, the carbon nanotubes 146 are multiwall carbon nanotubes (MWCNTs). In another example, the carbon nanotubes 146 are prestressed multiwall carbon nanotubes (PSMWCNTs). In yet another example, the carbon nanotubes 146 are a combination of SWCNTs, MWCNTs, and/or PSMWCNTs.

PSMWCNTs may be made in accordance with various techniques. As an example, PSMWCNTs may be achieved by putting MWCNTs into a bomb chamber and using an explosion to rapidly increase the pressure to force the walls of the MWCNTs to compress to within a distance where van der Waals forces dominate. As one example, PSMWCNTs may be achieved by exposing MWCNTs to radiation to increase pressure.

In one particular, non-limiting example, PSMWCNTs may have an interwall spacing ranging from approximately 0.22 nm to approximately 0.28 nm (e.g., compared to approximately 0.34 nm for conventional MWCNTs). Benefits offered by PSMWCNTs may include enhanced interwall shear strengths, which in turn improve load-transfer capabilities compared to those of normal MWCNTs. This provides axial tensile strength and Young's modulus that are approximately 20 percent higher than those of normal carbon nanotubes (CNTs).

Figure 7:
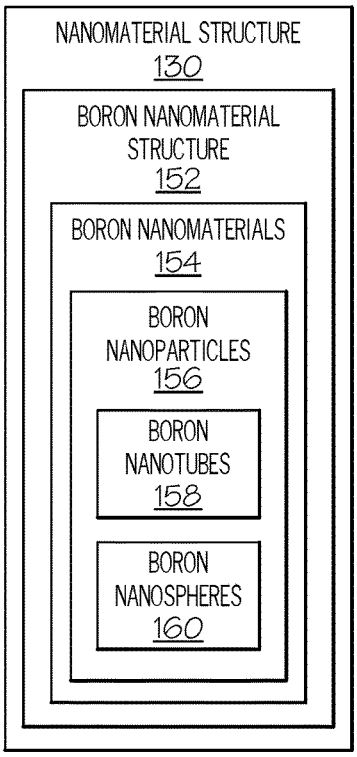
FIG. 7 is a schematic block diagram of another embodiment of the nanomaterial structure of the nanomaterial composite of FIG. 4.

FIG. 7 is a schematic block diagram of another embodiment of the nanomaterial structure 130 of the nanomaterial composite 126 of FIG. 4. In the illustrated embodiment of the nanomaterial structure 130, the nanomaterial structure 130 is a boron nanomaterial structure 152. The boron nanomaterial structure 152 is coupled to the carrier 128. The boron nanomaterial structure 152 includes boron nanomaterials 154 built upon the carrier 128. Thus, in such an embodiment, the nanomaterial composite 126 is a boron nanomaterial composite.

The boron nanomaterials 154 forming the boron nanomaterial structure 152 may take various forms. As an example, the boron nanomaterials 154 are (e.g., take the form of) boron nanoparticles 156. The boron nanoparticles 156 may have various geometries. As an example, the boron nanoparticles 156 include (e.g., take the form of) boron nanotubes 158. As another example, the boron nanoparticles 156 include (or take the form of) boron nanospheres 160. As another example, the boron nanoparticles 156 include at least one of or a combination of the boron nanotubes 158 and/or the boron nanospheres 160. As yet other examples, the boron nanoparticles 156 include quasi-planar boron clusters, layered boron, quasi-crystalline boron solid particles or a combination thereof. While various specific geometries of different types of boron nanoparticles 156 have been provided as examples, boron nanoparticles 156 having other geometries are also contemplated.

While various specific materials of different types have been provided as examples of the nanomaterials 132, in other embodiments, nanomaterials 132 having other material compositions are also contemplated. As an example, the nanomaterials 132 may include various other types of conductive nanomaterials. As another example, the nanomaterials 132 may include various other allotropes of carbon, boron and the like. As another example, the nanomaterials 132 may include other layered or van der Waals or lamellar nanomaterials including, for example, hexagonal boron nitride (hBN), molybdenum disulfide (MoS2), tungsten disulfide (WS2), boron nitride nanotubes and the like or a combination thereof. The particular nanomaterials 132 used may be selected, for example, based on one or more of desired frequency filtering, shielding effectiveness, desired electromagnetic performance characteristics and the like.

In another embodiment of the nanomaterial structure 130, the nanomaterial structure 130 includes a blend of different types of nanomaterials 132, for example, different nanoparticles 134 having different geometries (e.g., tube, sphere, etc.) or different constituent materials (e.g., carbon, boron, etc.). In an example of this embodiment, carbon is a conductive material, boron a resistive material, and when combined in different geometric ways, for example, using nanospheres, nanotubes or other configurations, different frequency responses, current handling, and/or structural material properties may result, which may be used to design RF filters, electrical shielding, or lightning diverters.

In addition to functioning as the FSS filter 104, utilization of the disclosed nanomaterial composite 126 may additionally provide multifunctional shielding from a variety of environmental effects, such as those from electromagnetic interference, radiation, electrical (e.g., lightning) and the like.

Figure 8:
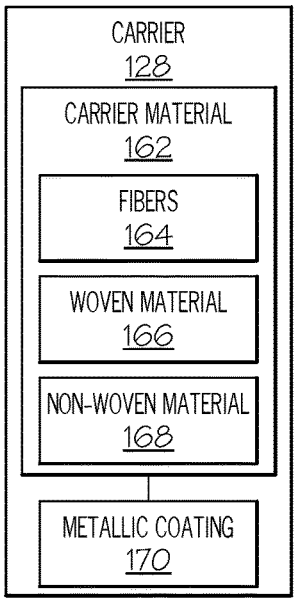
FIG. 8 is a schematic block diagram of one embodiment of a carrier of the nanomaterial composite of FIG. 4.

FIG. 8 is a schematic block diagram of one embodiment of the carrier 128 of the nanomaterial composite 126 of FIG. 4. In the illustrated embodiment, the carrier 128 includes (e.g., is fabricated from) a carrier material 162. The carrier material 162 includes any suitable material upon which the nanomaterials 132 may be overlaid to form (e.g., build and/or bond) the nanomaterial structure 130 upon the carrier 128.

In an example construction, the carrier 128 (e.g., the carrier material 162) includes a woven material 166. As examples, the carrier 128 may take the form of a woven scrim, cloth, fabric or mat. For example, the carrier material 162 includes fibers 164 that are woven together to form a thin woven carrier 128. In another example construction, the carrier 128 (e.g., the carrier material 162) includes a non-woven material 168. As examples, the carrier 128 may take the form of a non-woven veil, fabric or mat. For example, the carrier material 162 includes fibers 164 that are entangled or looped together to form a thin non-woven carrier 128.

In the example of the non-woven carrier 128, the entangled fibers 164 provide multidirectional improvements and uniformity in conductivity, at least some advantages in uniformity of tensile properties and impact strength, and/or greater electrical uniformity (e.g., as compared to a unidirectional fiber). Additionally, entanglement allows for the nanomaterials 132 to not just be sitting on the surface of the carrier 128, but to be essentially intertwined with (e.g., at least partially within) the carrier 128. Being intertwined also provides an advantage of plugging air gaps with nanomaterials 132, where if the nanomaterials 132 were just sitting on the surface of the carrier 128, the mechanical integrity of the interface between the nanomaterial structure 130 (e.g., the nanomaterials 132) and the carrier 128 would be weaker than if intertwined.

In an example, the carrier 128 (e.g., the carrier material 162) is conductive. The conductive carrier 128 provides enhanced lightning strike protection and broadband shielding effectiveness to the FSS composite structure 100.

In another example, the carrier 128 (e.g., the carrier material 162) is non-conductive. The non-conductive carrier 128 is beneficial in some cases to provide a dielectric or non-conductive barrier between the laminate panel 102 and the nanomaterial composite 126.

In another example, the carrier 128 (e.g., the carrier material 162) is a dielectric. The dielectric carrier 128 provides some advantages in keeping a lightning strike at the surface, helps prevent current from reaching the underlying FSS composite structure 100, and may be used for other purposes, such as precipitation static charge collection.

Ultimately, whether the carrier 128 is conductive, non-conductive or dielectric may depend on, for example, a particular application and/or desired properties of the nanomaterial composite 126. In yet another embodiment, the carrier 128 includes a combination of the conductive carrier material and the dielectric carrier material, which, when combined, form a dispersive dielectric material for use as a frequency-selective surface. The particular combination of the material system may be based on the application, the level of isolation desired or required, the level of conductivity desired or required, etc. for surface protection.

In the illustrated embodiment, the carrier 128 also includes a metallic coating 170. For example, the carrier material 162 is coated with the metallic coating 170. The metallic coating 170 provides lightning strike protection and low frequency shielding effectiveness. The nanomaterials 132 (e.g., the carbon nanomaterials 142) of the nanomaterial structure 130 provide medium to high frequency shielding effectiveness. Together, the metallic-coated carrier 128 and the nanomaterial structure 130 provide lightning strike protection and broadband shielding effectiveness.

Figure 9:
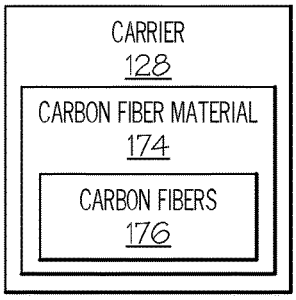
FIG. 9 is a schematic block diagram of another embodiment of the carrier of the nanomaterial composite of FIG. 4.

FIG. 9 is a schematic block diagram of another embodiment of the carrier 128 of the nanomaterial composite 126 of FIG. 4. In the illustrated embodiment, the carrier material 162 includes a carbon fiber material 174. The carbon fiber material 174 includes carbon fibers 176 (e.g., a plurality of continuous strands of carbon fibers). In an example, the carbon fiber material 174 includes carbon fibers 176 that are woven together to form a thin woven carrier 128 (e.g., a carbon fiber scrim). In another example, the carbon fiber material 174 includes carbon fibers 176 that are entangled or looped together to form a thin non-woven carrier 128 (e.g., a carbon fiber veil). In certain examples, the carbon fibers 176 are held together with a light binder (not explicitly illustrated).

In alternate embodiments of the carrier 128, the carrier material 162 includes nylon (e.g., nylon fibers), polyester (e.g., polyester fibers), PEEK (e.g., PEEK fibers), PEKK (e.g., PEKK fibers), fiberglass (e.g., fiberglass fibers), metalized polymer (e.g., metalized polymer fibers), metal meshes or foils (e.g., expanded copper foil), metalized carbon fiber (e.g., nickel coated carbon fiber), polyacrylonitrile (PAN) (e.g., PAN fibers), electrospun PAN nanofibers, tightly packed, wet-spun carbon nanotube threads and the like or combinations or hybrids thereof.

In other alternate embodiments of the carrier 128, the carrier material 162 includes glass (e.g., glass fibers) (e.g., E-glass, S-glass), aramid (e.g., aramid fibers) (e.g., Kevlar), fluoropolymer (e.g., fluoropolymer fibers) (e.g., Ultra High Molecular Weight Polyethylene, High Density Polyethylene, Teflon, etc.), polyimides (e.g., polyimides fibers), silicon carbide (e.g., silicon carbide fibers), alumina (e.g., alumina fibers), boron (e.g., boron fibers), hemp (e.g., hemp fibers), quartz (e.g., quartz fibers), ceramic (e.g., ceramic fibers), basalt (e.g., basalt fibers) and the like or combinations or hybrids thereof.

The particular carrier material 162 used for the carrier 128 may depend, at least in part, on the particular application and/or function of the disclosed nanomaterial composite 126, such as, but not limited to, bandpass filtering, electromagnetic interference (EMI) shielding, radiation shielding, ionizing radiation shielding, lightning protection, environmental protection, environmental isolation, scratch resistance, etc. As one example, when a higher conductivity of the nanomaterial composite 126 is desired or required, for example, for lightning strike protection and/or low frequency shielding effectiveness, the carrier 128 may be made from a conductive carrier material 162, for example, the carbon fiber material 174. As another example, when a lower conductivity of the nanomaterial composite 126 is desired or required, the carrier 128 may be made from a non-conductive carrier material 162. As a further example, fibers may be geometrically arranged to achieve two-dimensional or three-dimensional tensor conductivity and/or tensor dielectric properties, for use in tailoring how currents flow and are absorbed on the structure.

Figure 10:
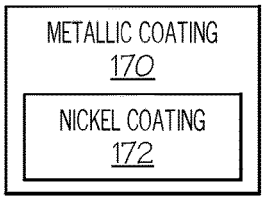
FIG. 10 is a schematic block diagram of one embodiment of a metallic coating of the carrier of FIG. 8.

FIG. 10 is a schematic block diagram of one embodiment of the metallic coating 170 of the carrier 128 of FIG. 8. In the illustrated embodiment, the metallic coating 170 is a nickel coating 172. Nickel (Ni) provides enhanced lightning strike protection and low frequency shielding effectiveness. As expressed above, the nanomaterials 132 (e.g., the carbon nanomaterials 142) of the nanomaterial structure 130 provide medium to high frequency shielding effectiveness. Together, the nickel-coated carrier 128 and the nanomaterial structure 130 provide enhanced lightning strike protection and broadband shielding effectiveness.

In alternate embodiments, other metals besides, or in addition to, nickel are used as the metallic coating 170. The particular metal used for the metallic coating 170 may be selected, for example, based on a desired shielding effectiveness, minimized skin effect depths at frequency or operation, or other properties.

The metallic coating 170 (e.g., nickel coating 172) may be applied to the carrier 128 by a variety of processes or techniques. As one example, the metallic coating 170 is applied to the carrier material 162 or individual ones of the fibers 164, for example, by a chemical vapor deposition process, an electroless plating process, or an electroplating process.

In an example, the metallic coating 170 (e.g., the nickel coating 172) is applied to one surface of the carrier 128. In another example, the metallic coating 170 is applied to both surfaces of the carrier 128. In examples where the metallic coating 170 is applied to both surfaces of the carrier 128, more of the metallic coating 170 may present on one surface than the other surface. As an example, when the nanomaterial composite 126 (e.g., at least carrier 128) includes the metallic coating 170, the surface of the carrier 128 to which the nanomaterial structure 130 is bonded may be opposite to the surface of the carrier 128 having more of the metallic coating 170.

In another example, individual fibers 164 (e.g., carbon fibers 176) or fiber tows are coated with nickel in a continuous chemical vapor deposition process. After a spool of the fibers 164 is coated (e.g., on all sides) with nickel, the Ni-coated fibers 164 are chopped up and formed into the nonwoven carrier material 162 (e.g., the Ni-coated nonwoven carbon fiber veil).

Thus, in an exemplary embodiment, the carrier 128 includes the carbon fiber material 174 (FIG. 9) coated with the nickel coating 172 (FIG. 10), for example, taking the form of a Ni-coated nonwoven carbon fiber veil.

Figure 11:
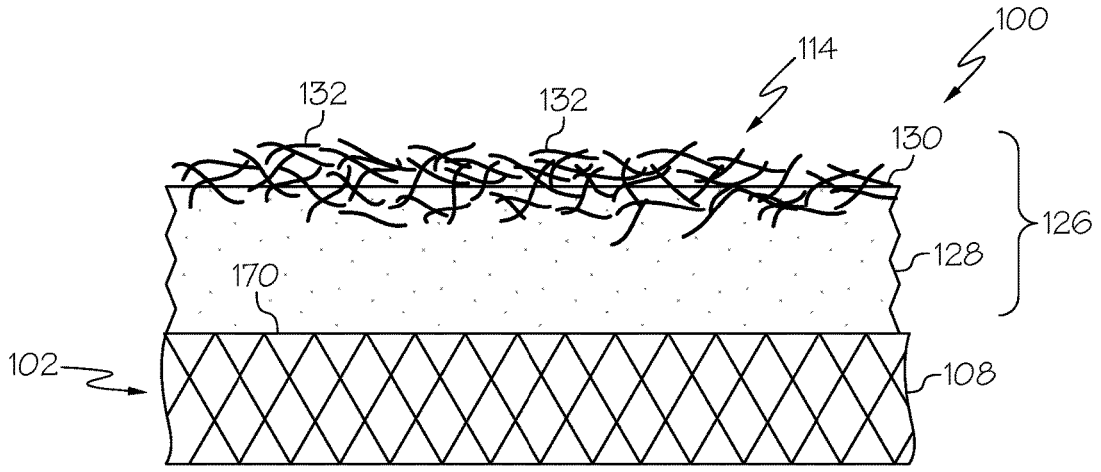
FIG. 11 is a schematic partial side elevation view, in section, of another embodiment of the disclosed frequency-selective surface composite structure.

FIG. 11 is a schematic partial side elevation view, in section, of another embodiment of the FSS composite structure 100. In the illustrated embodiment of the FSS composite structure 100, the nanomaterial composite 126 is oriented such that the carrier 128 is adjacent to (e.g., in contact with) the laminate panel 102 (e.g., the outermost FRP ply 108) and the nanomaterial structure 130 (e.g., the nanomaterials 132) is opposite the laminate panel 102. As such, the surface of the nanomaterial structure 130 defines the exterior surface of the FSS element 114. In embodiments where the carrier 128 includes the metallic coating 170, the surface of the carrier 128 having the metallic coating 170 is adjacent to the laminate panel 102.

Figure 12:
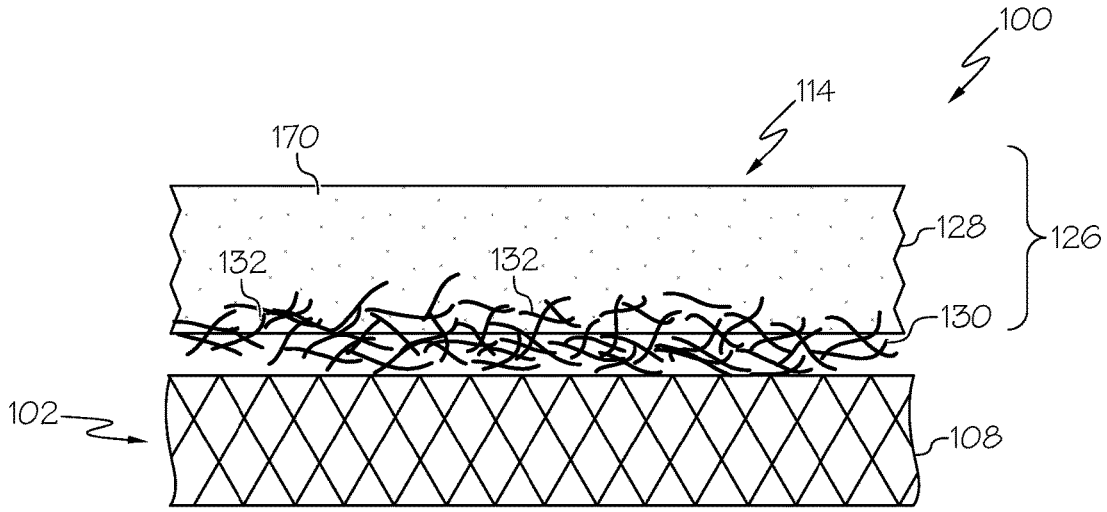
FIG. 12 is a schematic partial side elevation view, in section, of another embodiment of the disclosed frequency-selective surface composite structure.

FIG. 12 is a schematic partial side elevation view, in section, of another embodiment of the FSS composite structure 100. In the illustrated embodiment of the FSS composite structure 100, the nanomaterial composite 126 is oriented such that the nanomaterial structure 130 (e.g., the nanomaterials 132) is adjacent to (e.g., in contact with) the laminate panel 102 (e.g., the outermost FRP ply 108). As such, the surface of the carrier 128 defines the exterior surface of the FSS element 114. In embodiments where the carrier 128 includes the metallic coating 170, the surface of the carrier 128 having the metallic coating 170 defines the exterior surface of the FSS element 114.

In embodiments where the nanomaterial composite 126 is oriented such that the nanomaterial structure 130 is adjacent to (e.g., in contact with) the laminate panel 102, as illustrated in FIG. 12, the nanomaterials 132 forming the nanomaterial structure 130 are concentrated between the carrier 128 and the outermost FRP ply 108. In an example, at least some of the nanomaterials 132 are at least partially interspersed though and entangled with the FRP ply 108 to bond (e.g., permanently bond) the nanomaterial structure 130 to the laminate panel 102.

The orientation of the nanomaterial composite 126 relative to the laminate panel 102 may depend on various factors, such as the desired mechanical and/or electrical properties of FSS composite structure 100. As an example, when lightning strike protection is the primary purpose, the nanomaterial composite 126 may be oriented such that the metallic coating 170 is an exterior surface of the FSS composite structure 100 (FIG. 12). As another example, when frequency dependent EMI shielding is the primary purpose, the nanomaterial composite 126 may be oriented such that the nanomaterial structure 130 is an exterior surface of the FSS composite structure 100 (FIG. 11).

Accordingly, the disclosed nanomaterial composite 126 is effective in shielding against EMI. As an example, the nanomaterial composite 126 (e.g., the nanomaterial structure 130 coupled to the carrier 128) may provide effective EMI shielding at medium frequencies (between approximately 100 MHz and approximately 1 GHz) and at high frequencies (greater than approximately 1 GHz). As another example, the nanomaterial composite 126 having the metal coating 170 (e.g., the nanomaterial structure 130 coupled to the carrier 128 having the metallic coating 170) may be provide effective EMI shielding at low frequencies (less than approximately 100 MHz), medium frequencies (between approximately 100 MHz and approximately 1 GHz), and at high frequencies (greater than approximately 1 GHz). Further, the disclosed nanomaterial composite 126 is effective in shielding against electricity and dissipating voltage.

Similarly, the disclosed FSS composite structure 100 having the FSS elements 114 and the multifunctional layer 116 formed from the nanomaterial composite 126 may provide similar broadband EMI shielding effectiveness and lightning strike mitigation, which may be particularly beneficial in aerospace applications since different electromagnetic frequency bands may affect electronics, communications and avionics differently.

Figure 13:
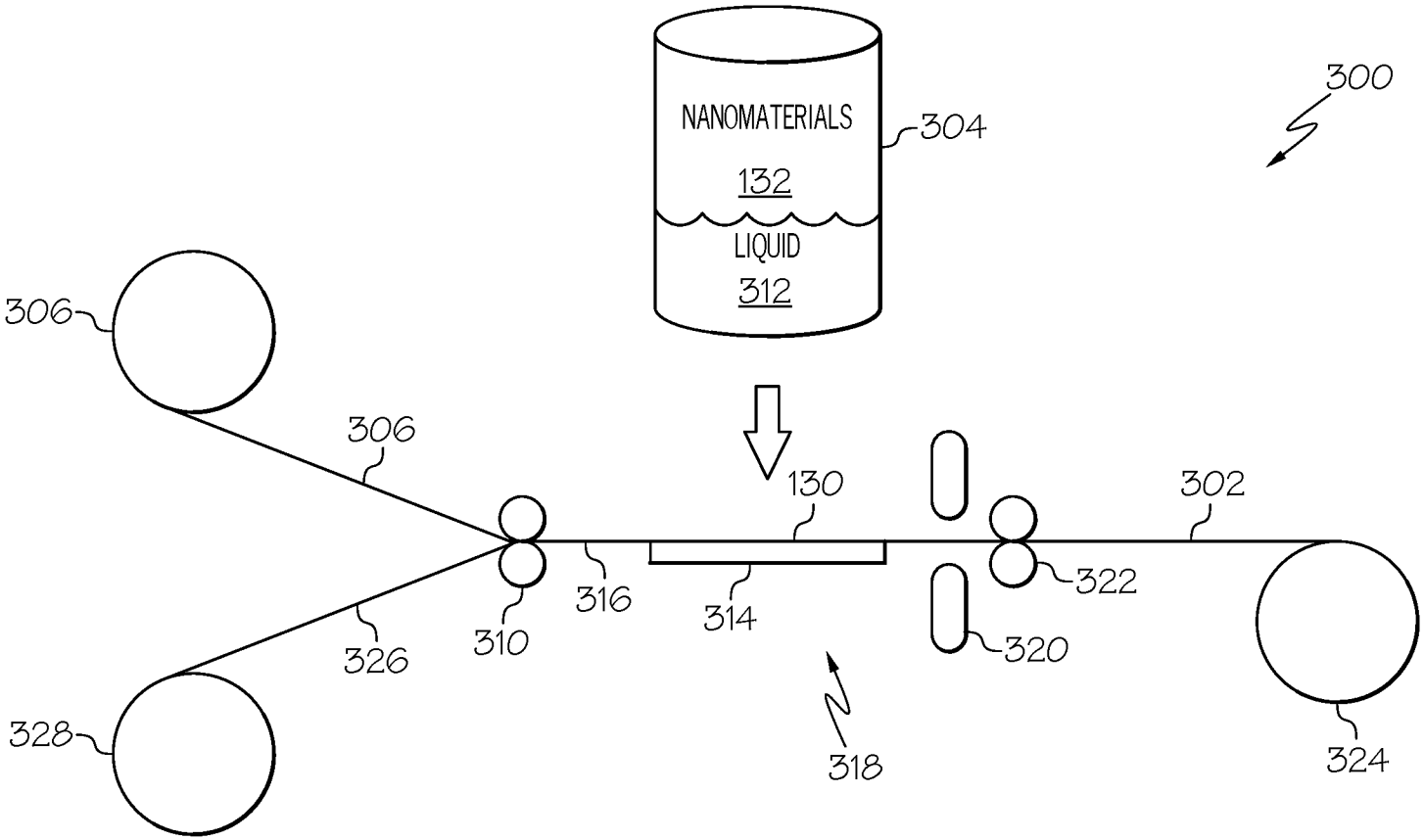
FIG. 13 is a schematic illustration of one embodiment of the disclosed system for making a nanomaterial composite sheet.

FIG. 13 is a schematic illustration of one embodiment of the system 300 for making a nanomaterial composite sheet 302. In the illustrated embodiment, the nanomaterial composite sheet 302 is made by overlaying a slurry 304 of the nanomaterials 132 and a liquid 312 onto a surface of a carrier sheet 306. At least one of pressure and/or heat is applied to the combination of the nanomaterial structure 130 (e.g., the nanomaterials 132) and the carrier sheet 306 to bond the two together and form the nanomaterial composite sheet 302.

As used herein, the nanomaterial composite sheet 302 is a continuous sheet of the nanomaterial composite 126. Similarly, as used herein, the carrier sheet 306 is a continuous sheet of the carrier 128. As used here, the term continuous means an elongated sheet having a length that is orders of magnitude greater than a width.

The slurry 304 is at least partially filtered through the carrier sheet 306 to build the nanomaterial structure 130 on the surface of the carrier sheet 306. Thus, in an example, the carrier sheet 306 (e.g., the carrier 128) is porous.

In an example, the system 300 includes a roll 308 of the carrier sheet 306. A pair of first rollers 310 pulls the carrier sheet 306 off of the roll 308 and direct and/or guide the carrier sheet 306 along a processing path. As examples, the first rollers 310 are guide rollers, nip rollers, pinch rollers or the like.

In the illustrated embodiment, the nanomaterials 132 and a liquid 312 are mixed to form the slurry 304 of the nanomaterials 132 and the liquid 312 (e.g., a fluid mixture or suspension of the nanomaterials 132 suspended in the liquid 312). The liquid 312 may be any suitable dispersive liquid or fluid carrier material into which the nanomaterials 132 are dispersed and suspended. Generally, as an example, the liquid 312 is non-reactive with the nanomaterials 132 (e.g., the nanomaterials 132 are insoluble in the liquid 312). In an exemplary embodiment, the liquid 312 is water. In alternate embodiments, the liquid 312 is an organic solvent, an acid, a resin (e.g., a thermoplastic or epoxy resin) or any other suitable dispersive liquid. The liquid 312 may also include one or more compounds for improving and/or stabilizing the dispersion and suspension of the nanomaterials 132 in the liquid 312.

Various chemical processes may be used to create the nanomaterials 132 that are mixed with the liquid 312 and used to form the nanomaterial structure 130. For example, various types of the nanotubes 136, manufactured in accordance with various techniques, may be used as the nanomaterials 132. In one example, the nanotubes 136 or other nanoparticles 134 are grown on a sheet (e.g., a stainless steel sheet). The grown nanotubes 136 are then be scraped away from the sheet.

In this example, the system 300 includes a forming table 314. Interaction between the slurry 304 (e.g., the nanomaterials 132 and the liquid 312) and the carrier sheet 306 to build the nanomaterial structure 130 occurs on the forming table 314. As an example, the forming table 314 includes a wire mesh or screen sufficient to support the carrier sheet 306 when the slurry 304 is dispensed (e.g., poured, sprayed, etc.) over the carrier sheet 306. As the slurry 304 is overlaid (e.g., poured) over the carrier sheet 306, the slurry 304 spreads out over the surface of the carrier sheet 306. The liquid 312 passes through the carrier sheet 306 and the nanomaterials 132 are filtered (e.g., sifted out and retained) by the carrier sheet 306 (e.g., on and/or at least partially below the surface of the carrier sheet 306) to form the nanomaterial structure 130.

In this example, the carrier sheet 306 is supported on a conveyor 316 (e.g., a conveyor belt), which carries the carrier sheet 306 along the processing path. The conveyor 316 may be a wire mesh or screen sufficient to support the carrier sheet 306 in a plane as the slurry 304 is dispensed over and filtered by the carrier sheet 306.

In this example, the system 300 also includes a vacuum zone 318 proximate to (e.g., below) the forming table 314 configured to provide a vacuum pressure sufficient to draw the slurry 304 from above (e.g., from an upper surface of) the carrier sheet 306 and through the carrier sheet 306, while allowing the nanomaterials 132 to entangle upon the surface and settle into (e.g., at least partially disperse through) the carrier sheet 306.

In this example, the system 300 includes one or more dryers 320 (e.g., to apply heat). The dryers 320 are located proximate to (e.g., at or near) the coupled combination of the nanomaterial structure 130 and the carrier sheet 306 along the processing path following the forming table 314. As an example, the dryers 320 are configured to dry the coupled combination of the nanomaterial structure 130 and the carrier sheet 306 (e.g., remove most or all of the remaining liquid 312) and form the nanomaterial composite sheet 302.

In this example, the system 300 also includes, or alternatively includes, one or more second rollers 322 (e.g., to apply pressure or pressure and heat). The second rollers 322 are configured to pull, direct or guide the coupled combination of the nanomaterial structure 130 and the carrier sheet 306 along the processing path. The second rollers 322 are also configured to compress the coupled combination of the nanomaterial structure 130 and the carrier sheet 306 to form the nanomaterial composite sheet 302. As examples, the second rollers 322 are guide rollers, nip rollers, pinch rollers or the like.

In this example, the second rollers 322 are heated rollers configured to increase the temperature of the coupled combination of the nanomaterial structure 130 and the carrier sheet 306, for example, to dry the coupled combination of the nanomaterial structure 130 and the carrier sheet 306 while the coupled combination of the nanomaterial structure 130 and the carrier sheet 306 is being compressed by the second rollers 322.

While only a single opposed pair of the second rollers 322 is illustrated by example in FIG. 13, in other embodiments, additional pairs of rollers are disposed along the processing path to incrementally compress (e.g., by between approximately 0.5 mil to approximately 1.0 mil) the coupled combination of the nanomaterial structure 130 and the carrier sheet 306, for example, in multiple stages.

In an example, the coupled combination of the nanomaterial structure 130 and the carrier sheet 306 are heated to between approximately 200° F. and approximately 300° F. (e.g., 220° F.) to remove the liquid 312 and/or dry the nanomaterial composite sheet 302 (e.g., form a dry nanomaterial composite sheet).

In an example, the coupled combination of the nanomaterial structure 130 and the carrier sheet 306 is (e.g., after being heated) compressed from a thickness of approximately 8 mils to form the nanomaterial composite sheet 302 having a thickness of approximately 6 mils (e.g., 6.3 mils) (e.g., a compressed nanomaterial composite sheet). Applying heat, pressure, or a combination of heat and pressure bonds and/or integrates the nanomaterial structure 130 and the carrier sheet 306 together. As an example, the applied pressure and/or heat is uniform and aids in creating the nanomaterial composite sheet 302 that is uniform and unitary (e.g., a uniform and unitary nanomaterial composite sheet).

Applying at least one of pressure and/or heat to the combination of the nanomaterial structure 130 and the carrier sheet 306 may also be referred to as laminating. As an example, applying pressure and/or heat to the combination of the nanomaterial structure 130 and the carrier sheet 306 further intersperses and integrates the nanomaterials 132 with the carrier sheet 306, for example, to bond the nanomaterial structure 130 and the carrier sheet 306 together.

Following the application of pressure and/or heat (e.g., the applying step), the nanomaterial composite sheet 302 may be rolled into a roll of the nanomaterial composite sheet 302.

The density of the nanomaterials 132 built up to form the nanomaterial structure 130 on the carrier sheet 306 may depend upon various factors including, but not limited to, the size and/or geometry of the nanomaterials 132, the type of the nanomaterials 132, a particular application of the nanomaterial composite 126 (e.g., a desired bandbass filter, a desired shielding effectiveness or attenuation at particular RF frequencies, a desired level of lightning strike protection, a desired conductivity level, a desired surface resistivity, and the like), a desired thickness of the nanomaterial structure 130, a desired weight of the nanomaterial structure 130, and the like.

As an example, the nanomaterials 132 have a basis weight of approximately 1 gram per square meter (gsm). As an example, the nanomaterials 132 have a relative density of less than approximately 1.0. As an example, the nanomaterial structure 130 has a basis weight of approximately 1 gram of the nanomaterial 132 per square meter (gsm). As another example, the nanomaterial structure 130 has a basis weight of at least 1 gram of the nanomaterial 132 per square meter (gsm).

In the illustrated embodiment, the nanomaterial composite sheet 302 also includes a protective sheet 326. In an example, the system 300 includes a roll 328 of continuous protective sheet 326. As an example, the protective sheet 326 is releasably coupled to the carrier sheet 306 opposite the nanomaterial structure 130. The protective sheet 326 may protect nanomaterial composite sheet 302, for example, when rolled into the roll 324. The protective sheet 326 is removed from nanomaterial composite sheet 302 prior to use of nanomaterial composite sheet 302 in a particular application, for example, when used to form the FSS filter 104 of the FSS composite structure 100. The protective sheet 326 may also be referred to as a protective layer or release film. As examples, the protective sheet 326 includes (e.g., takes the form of) a sheet of a polytetrafluoroethylene glass material, such as ARMALON™ polytetrafluoroethylene glass laminate, paper, a polyester film, a sheet of polyethylene terephthalate (PET) (e.g., MYLAR®) and the like.

FIG. 14 is a schematic illustration of one embodiment of an antenna system 200. The disclosed antenna system 200 includes a radio frequency (RF) antenna 202 positioned relative and enclosed by the disclosed FSS composite structure 100. The RF antenna 202 is physically and electromagnetically protected by the FSS composite structure 100. As expressed above, the FSS composite structure 100 provides bandpass filtering for operating frequencies of the RF antenna 202, enhanced durability and damage protection to the RF antenna 202, broadband electromagnetic interference shielding effectiveness for the RF antenna 202, and lightning strike protection for the RF antenna 202.

In the illustrated embodiment of the antenna system 200, the RF antenna 202 is positioned behind the FSS composite structure 100. As an example, the RF antenna 202 is positioned directly behind FSS filter 104 formed by the FSS pattern 112 of FSS elements 114 (e.g., behind the RF window 110).

In an example construction, the RF antenna 202 includes one or more antenna elements 210 coupled to a radio 212. The radio 212 includes a radio transmitter and a radio receiver configured to operate at an operating frequency. As an example, the RF antenna 202 includes one or more conformal antenna elements 210 coupled (e.g., mechanically connected, adhesively bonded, etc.) to the FSS composite structure 100. As another example, the RF antenna 202 includes one or more flat antenna elements 210 (e.g., dipole, horn, or patch antennas) mechanically coupled (e.g., fastened) to the FSS composite structure 100.

Other suitably types of antenna elements are also contemplated. The shape or configuration of the antenna element 210 of RF antenna 202 is dependent upon coverage and polarization desired, consideration of radiation pattern overlap with other antennas, and proximity of nearby structures.

As examples, the RF antenna 202 used for the antenna system 200 is a phased array antenna variant, an aperture antenna variant, a wire or slot antenna variant, or the like. The type of RF antenna 202 is not constrained by the implementation of the disclosed FSS composite structure 100, except to determine the size of the FSS composite structure 100, the frequency of operation of FSS filter 104, the dielectric tensor properties of the constituent FSS pattern 112, and geometric and materials configuration of the FSS elements 114. As examples, the RF antenna 202 may be a planar antenna, implemented as an applique bonded to the inner mold line of the FSS composite structure 100, or may be a planar or volumetric antenna spaced well apart from the FSS composite structure 100.

In another example construction, the RF antenna 202 may require one or more shallow or deep backing cavities (not explicitly illustrated) to enforce unidirectional radiation, depending on wavelength of operation and dielectric or ferrite material used inside of the cavity, choice of radiating element (e.g., antenna elements 210), radiating element count (e.g., if it is an array), and electrical size. Some applications may not enforce unidirectional radiation at all, in the case in which the FSS composite structure 100 wraps to form two opposing faces, such as a vertical tail or wing of an aircraft (e.g., aircraft 1200).

In another embodiment of the antenna system 200, the RF antenna 202 is sandwiched between plies (e.g., FRP plies 108) of the laminate (e.g., the laminate panel 102) used in the FSS composite structure 100, or may be bonded to the outer mold line of the FSS composite structure 100, or inner mold line of the FSS composite structure 100, depending on the accessibility, access and repairability, damage tolerance, and durability required of the antenna element (e.g., antenna element 210) itself. If sandwiched, the RF antenna 202 may be simply copper etched on a film, such as polyimide, and included in the lay-up, or bonded to the prepared surface of the FSS composite structure 100 after layup and cure.

The multifunctional layer 116 also provides a path to ground for any voltage. As one example, the multifunctional layer 116 is grounded to an underlying support structure 206 (e.g., an airframe). In an example construction, the FSS composite structure 100 is coupled to the support structure 206 by a plurality of fasteners 208. At least one of the fasteners 208 passes through at least a portion of the multifunctional layer 116 to ground the multifunctional layer 116.

Accordingly, the nanomaterial composite 126 forming the FSS filter 104 and the multifunctional layer 116 of the disclosed FSS composite structure 100 provides enhanced durability and damage protection provided by the carrier 128, broadband shielding effectiveness provided by the combination of the carrier 128 and the nanomaterial structure 130 and bandpass filtering for the underlying antenna frequency provided by the FSS elements 114 arranged in the FSS pattern 112 to the RF antenna 202.

Figure 15:
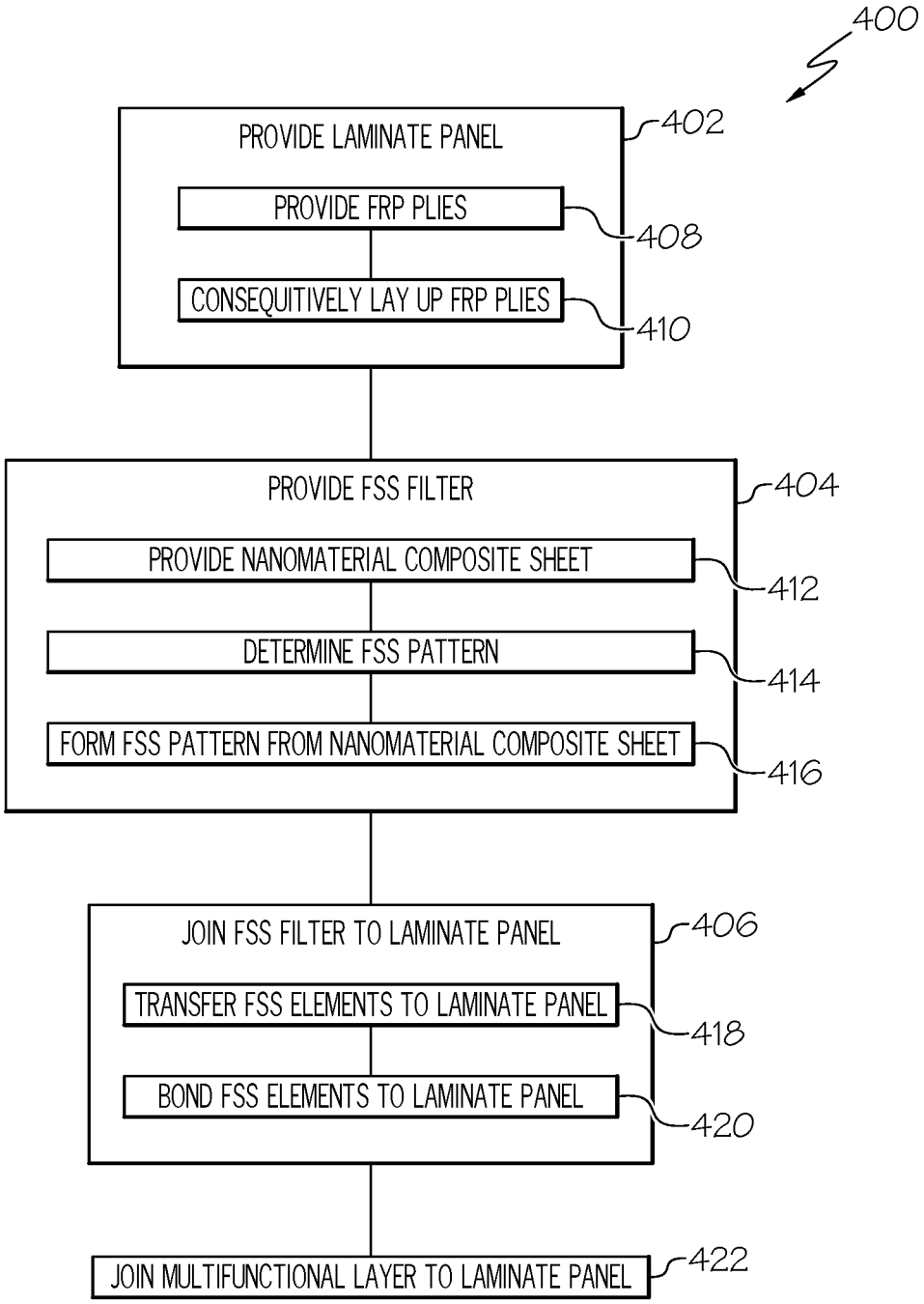
FIG. 15 is a flow diagram illustrating one embodiment of the disclosed method for making the frequency-selective surface composite structure.

FIG. 15 is a flow diagram illustrating one embodiment of the disclosed method 400 for making the FSS composite structure 100. Modifications, additions, or omissions may be made to method 400 without departing from the scope of the present disclosure. Method 400 may include more, fewer, or other steps. Additionally, steps may be performed in any suitable order.

The illustrated embodiment of the disclosed method 400 includes the step of providing the laminate panel 102, as shown at block 402. As shown at block 404, the method 400 includes the step of providing the FSS filter 104. As shown at block 406, the method 400 includes the step of joining the FSS filter 104 to the laminate panel 102.

In the illustrated embodiment of the method 400, the step of providing the laminate panel 102 (block 402) includes the steps of providing one or more FRP plies 108, as shown at block 408, and consecutively lay up (e.g., stack) the FRP plies 108, for example, in a mold (not explicitly illustrated), as shown at block 410.

In the illustrated embodiment of the method 400, the step of providing the FSS filter 104 (block 404) includes the step of providing the nanomaterial composite sheet 302, as shown at block 412. The nanomaterial composite sheet 302 may be made using the disclosed system 300 (FIG. 13). As shown at block 414, the step of providing the FSS filter 104 (block 404) includes the step determining the FSS pattern 112. The FSS pattern 112 includes the shape, size and/or arrangement of the FSS elements 114.

The design requirements of the FSS filter 104 are determined principally by the frequency band of operation and field of view of the RF antenna 202. The purpose of FSS filter 104 and its constituent components may vary widely and affect its design. In some designs, it may be to reduce co-site interference between nearby antenna installations on a crowded airframe. In other cases, it may be necessary to reduce radar echo from the antenna, through reduction of its antenna and structural mode radar cross section at frequencies outside of the band of operation. In still other cases, it may be necessary to provide different reflection or refraction at different aspect angles to the antenna, to correct angular-dependent depolarization or boresight error losses. In some cases, power handling capabilities of the antenna affect choices in design of the FSS filter 104, choice of materials, and implementation, including implementing heat dissipating, radiating features into the frequency-selective surface layer, such as heat channels.

The step of providing the FSS filter 104 (block 404) includes the step of forming the FSS pattern 112 from the nanomaterial composite sheet 302, as shown at block 416. In an example, the FSS pattern 112 is formed by cutting away portions of the nanomaterial composite sheet 302 to leave the FSS elements 114 arranged in the FSS pattern 112. As an example, a computer controlled laser trimmer removes (e.g., ablates) portions of the nanomaterial composite sheet 302 from the underlying protective sheet 326. The protective sheet 326 keeps the FSS elements 114 arranged in the FSS pattern 112 so that the entire FSS pattern 112 of the FSS elements 114 can be located, as a whole, on the exterior surface of the laminate panel 102. As an example, the protective sheet 326 keeps the plurality of FSS elements 114 positioned relative to one another and spaced apart from one another (e.g., at distances D1 and D2) in accordance with the design of the FSS pattern 112.

In the illustrated embodiment of the method 400, the step joining the FSS filter 104 to the laminate panel 102 (block 406) includes the step of transferring the FSS elements 114 arranged in the FSS pattern 112 to the panel-exterior surface 120 of the laminate panel 102, as shown at block 418. In one example, the entire FSS pattern 112 of FSS elements 114 is transferred to the laminate panel 102 as a whole. The nanomaterial composite sheet 302 having the FSS pattern 112 is laid up on the laminate panel 102 (e.g., the outermost FRP ply 108 of the stack of FRP plies 108). The FSS elements 114 are placed in contact with the panel-exterior surface 120 of the laminate panel 102. The adhesion force between the laminate panel 102 and the FSS elements 114 (e.g., due to the matrix material of the FRP ply 108) may be greater than the adhesion force between the FSS elements 114 and the protective sheet 326, thus, allowing the protective sheet 326 to be peeled away and leaving the FSS elements 114 on the panel-exterior surface 120 arranged in the FSS pattern 112. As an example, the nanomaterial composite sheet 302 includes one or more registration features (not explicitly illustrated). The registration features allow the FSS pattern 112 of FSS elements 114 to be appropriately positioned relative to the lay up of one or more FRP plies 108 or the lay up tool (e.g., the mold). Other methods of applying the FSS elements 114 arranged in the FSS pattern 112 are also contemplated.

The step joining the FSS filter 104 to the laminate panel 102 (block 406) also includes the step of bonding the FSS elements 114 to the panel-exterior surface 120 of the laminate panel 102, as shown at block 420. As an example, the FSS elements 114 arranged in the FSS pattern 112 forming the FSS filter 104 and the FRP plies 108 forming the laminate panel 102 are co-cured. Other methods of bonding the FSS elements 114 to the laminate panel 102 are also contemplated, such as adhesive bonding.

In the illustrated embodiment, the method 400 also includes the step of joining the multifunctional layer 116 to the laminate panel 102, as shown at block 422. The step of joining the multifunctional layer 116 to the laminate panel 102 (block 422) may be performed simultaneously with the step of joining the FSS filter 104 to the laminate panel 102 (block 406). As an example, the size of the multifunctional layer 116 and the size and shape of the opening 118 in the multifunctional layer 116 surrounding the FSS filter 104 are formed by the laser trimmer when the FSS pattern 112 is being formed.

Figure 16:
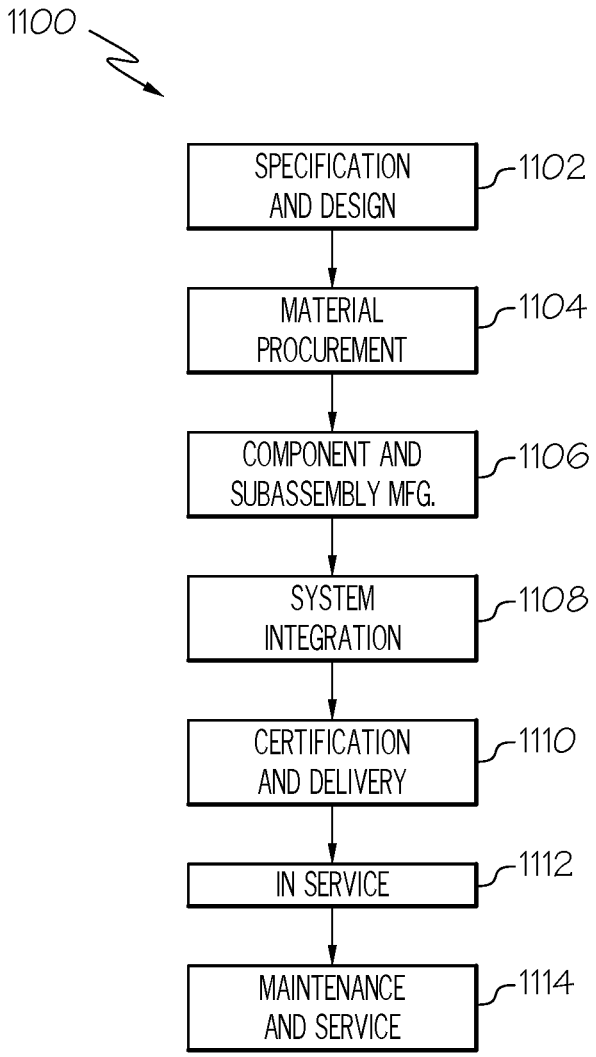
FIG. 16 is a block diagram of aircraft production and service methodology.
Figure 17:
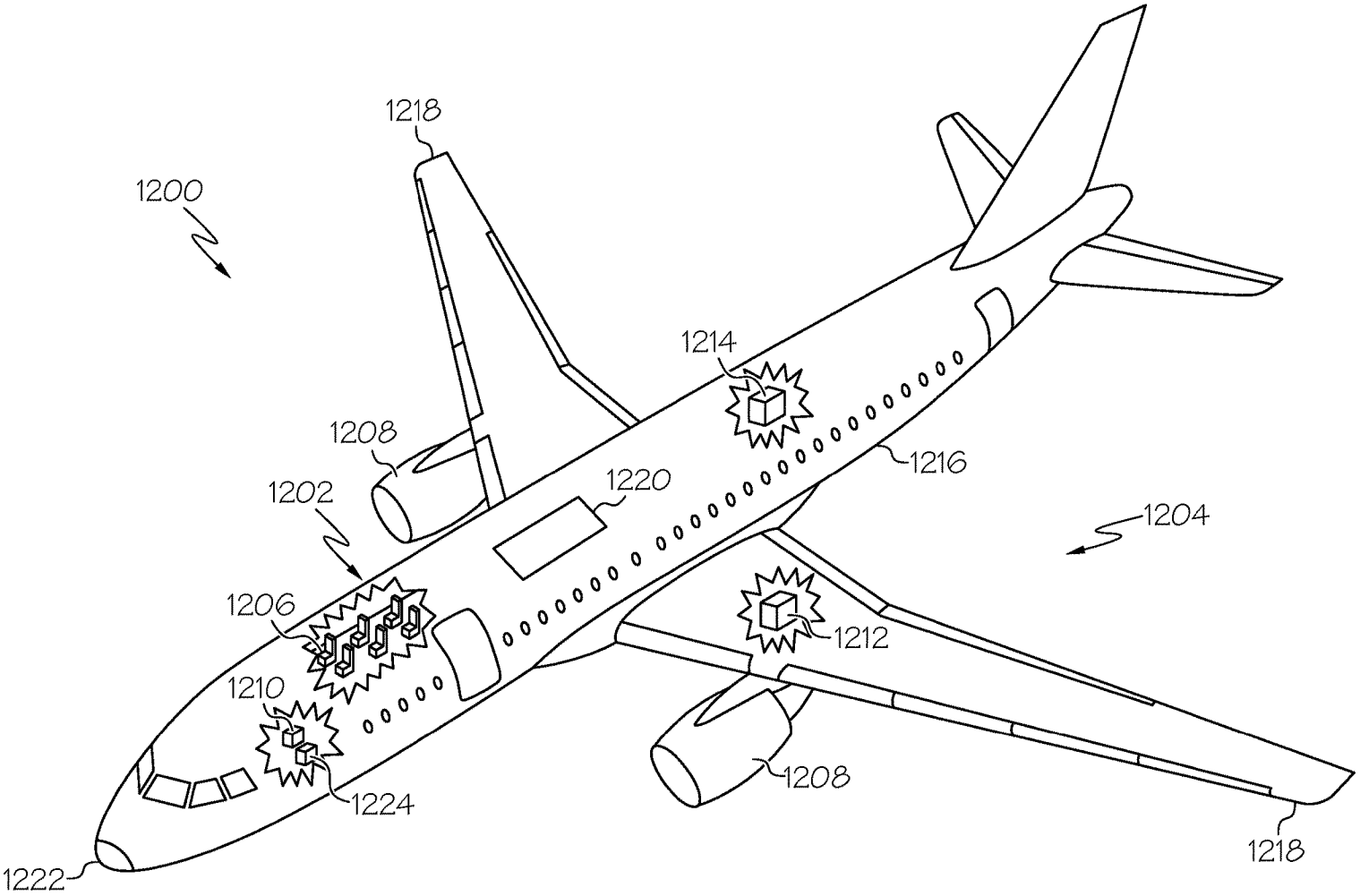
FIG. 17 is a schematic illustration of an aircraft.

FIG. 16 is a block diagram of aircraft production and service methodology 16. FIG. 17 is a schematic illustration of an aircraft 1200. Examples of the apparatus, system and method for making the apparatus disclosed herein may be described in the context of the aircraft manufacturing and service method 1100 and the aircraft 1200.

During pre-production, the illustrative method 1100 may include specification and design, as shown at block 1102, of the aircraft 1200, which may include design (e.g., optimization of the geometry, pattern and/or placement) of the FSS elements 114, and material procurement, as shown at block 1104. During production, component and subassembly manufacturing, as shown at block 1106, and system integration, as shown at block 1108, of the aircraft 1200 may take place. Thereafter, the aircraft 1200 may go through certification and delivery, as shown block 1110, to be placed in service, as shown at block 1112. While in service, the aircraft 1200 may be scheduled for routine maintenance and service, as shown at block 1114. Routine maintenance and service may include modification, reconfiguration, refurbishment, etc. of one or more systems of the aircraft 1200.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 17, the aircraft 1200 produced by the illustrative method 1100 includes an airframe 1202 that includes one or more of the disclosed FSS composite structures 100, as described with respect to FIGS. 1 and 2. In various implementations, the disclosed FSS composite structure 100 may be used to form different structures or components of the aircraft 1200. For example, a plurality of FSS composite structures 100 may be interconnected to form a larger structure having a three-dimensional shape with various dimensions. As one example, one or more FSS composite structures 100 may form a portion of the airframe 1202 of the aircraft 1200 other primary or secondary structure of the aircraft 1200, such as a fuselage 1216, a wing 1218 and the like. As another example, one or more FSS composite structures 100 may form a skin panel 1220 forming the fuselage 1216, the wing 1218 or other primary or secondary structure of the aircraft 1200. As yet another example, one or more FSS composite structures 100 may form a radome 1222.

The aircraft 1200 produced by the illustrative method 1100 also includes a plurality of high-level systems 1204 and an interior 1206. Examples of the high-level systems 1204 include one or more of a propulsion system 1208, an electrical system 1210, a hydraulic system 1212, an environmental system 1214 and a communications system 1224 (e.g., the antenna system 200). Any number of other systems may be included.

Although an aerospace example is shown, the principles disclosed herein may be applied to other industries, such as the automotive industry, the marine industry and the like.

The apparatus, systems and methods shown or described herein may be employed during any one or more of the stages of the manufacturing and service method 1100. For example, components or subassemblies corresponding to component and subassembly manufacturing (block 1106) may be fabricated or manufactured in a manner similar to components or subassemblies produced while aircraft 1200 is in service (block 1112). Also, one or more examples of the systems, apparatus, and methods, or combination thereof may be utilized during production stages (blocks 1108 and 1110). Similarly, one or more examples of the systems, apparatus, and methods, or a combination thereof, may be utilized, for example and without limitation, while aircraft 1200 is in service (block 1112) and during maintenance and service stage (block 1114).

Reference herein to "embodiment" means that one or more feature, structure, element, component or characteristic described in connection with the embodiment is included in at least one implementation. Thus, the phrase "an embodiment," "another embodiment," and similar language throughout the present disclosure may, but do not necessarily, refer to the same embodiment. Further, the subject matter characterizing any one embodiment may, but does not necessarily, include the subject matter characterizing any other embodiment.

Similarly, reference herein to "example" means that one or more feature, structure, element, component or characteristic described in connection with the example is included in at least one embodiment. Thus, the phrases "an example," "another example," and similar language throughout the present disclosure may, but do not necessarily, refer to the same example. Further, the subject matter characterizing any one example may, but does not necessarily, include the subject matter characterizing any other example.

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of lower-numbered item (e.g., a "first" item) and/or a higher-numbered item (e.g., a "third" item).

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example and without limitation, two of item A, one of item B, and ten of item C; four of item B and seven of item C; or some other suitable combination.

In FIGS. 4-10, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships among the various disclosed elements are necessarily represented. Accordingly, couplings other than those depicted in the block diagrams may also exist. Dashed lines, if any, connecting blocks designating the various elements and/or components represent couplings similar in function and purpose to those represented by solid lines; however, couplings represented by the dashed lines may either be selectively provided or may relate to alternative examples of the present disclosure. Likewise, elements and/or components, if any, represented with dashed lines, indicate alternative examples of the present disclosure. One or more elements shown in solid and/or dashed lines may be omitted from a particular example without departing from the scope of the present disclosure. Environmental elements, if any, are represented with dotted lines. Virtual (imaginary) elements may also be shown for clarity. Those skilled in the art will appreciate that some of the features illustrated in FIGS. 4-10 may be combined in various ways without the need to include other features described in FIGS. 4-10, other drawing figures, and/or the accompanying disclosure, even though such combination or combinations are not explicitly illustrated herein. Similarly, additional features not limited to the examples presented, may be combined with some or all of the features shown and described herein.

In FIGS. 15 and 16, referred to above, the blocks may represent operations and/or portions thereof and lines connecting the various blocks do not imply any particular order or dependency of the operations or portions thereof. Blocks represented by dashed lines indicate alternative operations and/or portions thereof. Dashed lines, if any, connecting the various blocks represent alternative dependencies of the operations or portions thereof. It will be understood that not all dependencies among the various disclosed operations are necessarily represented. FIGS. 15 and 16 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

Although various embodiments of the disclosed apparatus, system and method have been shown and described, modifications may occur to those skilled in the art upon reading the specification. The present application includes such modifications and is limited only by the scope of the claims.

What is claimed is:

1. A frequency-selective surface composite structure comprising:

a laminate panel;

a frequency-selective surface filter comprising a plurality of frequency-selective surface elements coupled to an exterior surface of said laminate panel and arranged in a frequency-selective surface pattern; and a multifunctional layer coupled to said exterior surface of said laminate panel and surrounding said frequency-selective surface filter, wherein each one of said frequency-selective surface elements and said multifunctional layer comprises a nanomaterial composite.

2. The frequency-selective surface composite structure of claim 1 wherein said nanomaterial composite comprises:

a carrier; and a nanomaterial structure bonded to said carrier.

3. The frequency-selective surface composite structure of claim 2 wherein said nanomaterial structure comprises a network of nanomaterials deposited on a surface of said carrier.

4. The frequency-selective composite structure of claim 3 wherein said nanomaterials are conductive.

5. The frequency-selective surface composite structure of claim 3 wherein said nanomaterials are carbon nanotubes.

6. The frequency-selective surface composite structure of claim 2 wherein said carrier comprises one of a woven or a non-woven carbon fiber material.

7. The frequency-selective surface composite structure of claim 6 wherein said carrier further comprises a metallic coating.

8. The frequency-selective surface composite structure of claim 7 wherein said metallic coating comprises a nickel coating.

9. The frequency-selective surface composite structure of claim 1 wherein said plurality of frequency-selective surface elements are suitably spaced apart to dissipate an electrical voltage across said frequency-selective surface pattern.

10. The frequency-selective composite structure of claim 1 wherein said plurality of frequency-selective surface elements are suitably spaced apart from said multifunctional layer to dissipate an electrical voltage from said frequency-selective surface pattern to said multifunctional layer, and wherein said multifunctional layer is grounded.

11. An antenna system comprising:

a frequency-selective surface composite structure comprising:

a laminate panel;

a frequency-selective surface filter comprising a plurality of frequency-selective surface elements coupled to an exterior surface of said laminate panel and arranged in a frequency-selective surface pattern; and a multifunctional layer coupled to said exterior surface of said laminate panel and surrounding said frequency-selective surface filter, wherein each one of said frequency-selective surface elements and said multifunctional layer comprises a nanomaterial composite; and an RF antenna positioned behind said frequency-selective filter.

12. The antenna system of claim 11 wherein said nanomaterial composite comprises:

a carrier; and a nanomaterial structure bonded to said carrier.

13. The antenna system of claim 12 wherein said nanomaterial structure comprises a network of carbon nanotubes deposited on a surface of said carrier.

14. The antenna system of claim 13 wherein said carrier comprises:

one of a woven or a non-woven carbon fiber material; and a metallic coating.

15. The antenna system of claim 14 wherein said metallic coating comprises a nickel coating.

16. The antenna system of claim 11 wherein said plurality of frequency-selective surface elements are suitably spaced apart to dissipate an electrical voltage across said frequency-selective surface pattern.

17. The antenna system of claim 16 wherein:

said plurality of frequency-selective surface elements are suitably spaced apart from said multifunctional layer to dissipate said electrical voltage from said frequency-selective surface pattern to said multifunctional layer; and said multifunctional layer is grounded to an underlying support structure.

18. A method for making a frequency-selective composite structure, said method comprising:

providing a laminate panel;

providing a frequency-selective surface filter comprising a plurality of frequency-selective surface elements coupled to an exterior surface of said laminate panel and arranged in a frequency-selective surface pattern, wherein each one of said frequency-selective surface elements comprises a nanomaterial composite; and co-curing said laminate panel and said plurality of frequency-selective surface elements.

19. The method of claim 18 further comprising transferring said plurality of frequency-selective surface elements arranged in said frequency-selective surface pattern to said exterior surface of said laminate panel prior to co-curing.

20. The method of claim 18 further comprising coupling a multifunctional layer to said exterior surface of said laminate panel, surrounding said frequency-selective surface filter.

* * * * *